United States Patent [19]

Mima

[11] 4,419,859

[45] Dec. 13, 1983

[54] SPLICING APPARATUS FOR SPUN YARNS

[75] Inventor: Hiroshi Mima, Joyo, Japan

[73] Assignee: Murata Kikai Kabushiki Kaisha, Kyoto, Japan

[21] Appl. No.: 359,947

[22] Filed: Mar. 19, 1982

[30] Foreign Application Priority Data

Mar. 24, 1981 [JP] Japan ..... 56-43662

[51] Int. Cl.[3] ..... D01H 15/00

[52] U.S. Cl. ..... 57/22; 57/261

[58] Field of Search ..... 57/22, 23, 261

[56] References Cited

U.S. PATENT DOCUMENTS 4,217,749 8/1980 Rohner et al. ..... 57/261
4,246,744 1/1981 Matsui et al. ..... 57/22
4,263,775 4/1981 Mima ..... 57/22
4,322,943 4/1982 Rohner et al. ..... 57/22 X
4,344,277 8/1982 Rohner et al. ..... 57/22

*Primary Examiner*—Donald Watkins
*Attorney, Agent, or Firm*—Spensley, Horn, Jubas & Lubitz

[57] ABSTRACT

A splicing apparatus for spun yarns includes a splicing member having a cylindrical splicing hole formed to pierce through the splicing member, a V-groove, a slit extended from the lower end of the V-groove to the upper portion of the splicing hole and a jet nozzle opened in the splicing hole. Control plates for covering the opening of the splicing hole partially is arranged to be adjustable on both the sides of the splicing member to control the quantity of the fluid flowed out from the opening of the splicing hole.

8 Claims, 25 Drawing Figures

SPLICING APPARATUS FOR SPUN YARNS

BACKGROUND OF THE INVENTION

As the known splicing method for spun yarns, there can be mentioned a fisherman's knot splicing method and weaver's knot splicing method, and these methods are valuable as methods enabling mass production. However, these methods are fatally defective in that the size of the formed knot is very large and about 3 times the size of the single yarn and this large size of the knot causes such troubles as yarn breakage at the subsequent processing step. Accordingly, there has been developed a splicing method and apparatus providing a joint having a structure quite different from the structure of the conventional fisherman's knot or weaver's knot. According to this technique, a compressed fluid is jetted to the lapped portion of two yarn ends to be spliced, whereby both the yarn ends are mingled and integrated fibers of both the yarn ends are entangled with one another to effect splicing.

The joint formed by this splicing technique has in principle an integrated structure in which both the yarns are mingled with each other and top ends of the respective fibers are entangled with one another and wrapped in one another and certain twists are given to the entire joint.

Although the size of the fisherman's knot or weaver's knot is about 3 times the size of the single yarn, the size of the above-mentioned joint formed by jetting of a compressed fluid is less than 1.5 times the size of the single yarn. In this connection, this splicing method may be called an epochmaking method. However, this splicing method is defective in that the binding strength of the formed joint is lower than that of the fisherman's knot or weaver's knot. In case of the fisherman's knot or weaver's knot, the knot strength is in principle equal to or higher than the strength of the single yarn, though the joint strength is lower than that of the single yarn in some yarns, for example, polyester-cottom mix-spun yarns and acrylic yarns. However, in the method utilizing a compressed fluid, the strength of the formed joint is inevitably lower than the strength of the single yarn irrespectively of the kind and count number of the yarn or the length of fibers constituting the single yarn. In this method utilizing a compressed fluid, the binding strength differs according to the count number. More specifically, as the size of the yarn is small, the binding strength is relatively increased and is about 70 to about 85% of the strength of the single yarn. On the other hand, as the size is increased, the binding strength is reduced and is sometimes less than 50% of the strength of the single yarn. Moreover, even if the count number is the same, the binding strength differs according to the condition of the formed joint and horny projections are formed in the vicinity of both the ends of the formed joint. Thus, this method utilizing a compressed fluid is still insufficient and defective in various points.

SUMMARY OF THE INVENTION

The present invention relates to a splicing apparatus for spun yarns in which a compressed fluid is jetted onto the lapped portion of two yarn ends to effect splicing.

A primary object of the present invention is to provide a splicing method and apparatus in which the foregoing defects and disadvantages are eliminated and a joint having a binding strength superior or comparable to that of the conventional fisherman's knot or weaver's knot can be formed stably without formation of undesirable horny projections.

According to the present invention, there is provided a splicing apparatus for spun yarns which includes a splicing member having a splicing hole and a jet nozzle for jetting a compressed fluid into the splicing hole and control plates located on both the outer sides of the splicing hole of the splicing member being capable to be adjusted at the located position. The control plates are so arranged that side edges of the control plates traverse a part of an opening of the splicing hole to cover a part of the opening and to reduce the size of the opening of the splicing hole.

The following effects can be attained by the splicing apparatus according to the present invention.

Since the majority of the compressed fluid jetted from the jet nozzle can be swirled effectively by reducing the size of the opening of the splicing hole by the control member, it is possible to strongly balloon the yarn ends and highly improve the binding strength of the joint. Since the flow of the compressed fluid in the splicing hole is stabilized as compared with the conventional technique not utilizing the control members, occurrence of such troubles as yarn breakage can be prevented effectively. Moreover, if the control members are arranged so that the area covered of the section of the splicing hole can optionally be changed, the foregoing effects can further be enhanced appropriately according to the kind of the yarn to be spliced and the intended joint.

DETAILED DESCRIPTION OF THE INVENTION

The present invention will now be described in detail with reference to embodiments illustrated in the accompanying drawings.

Figure 1:
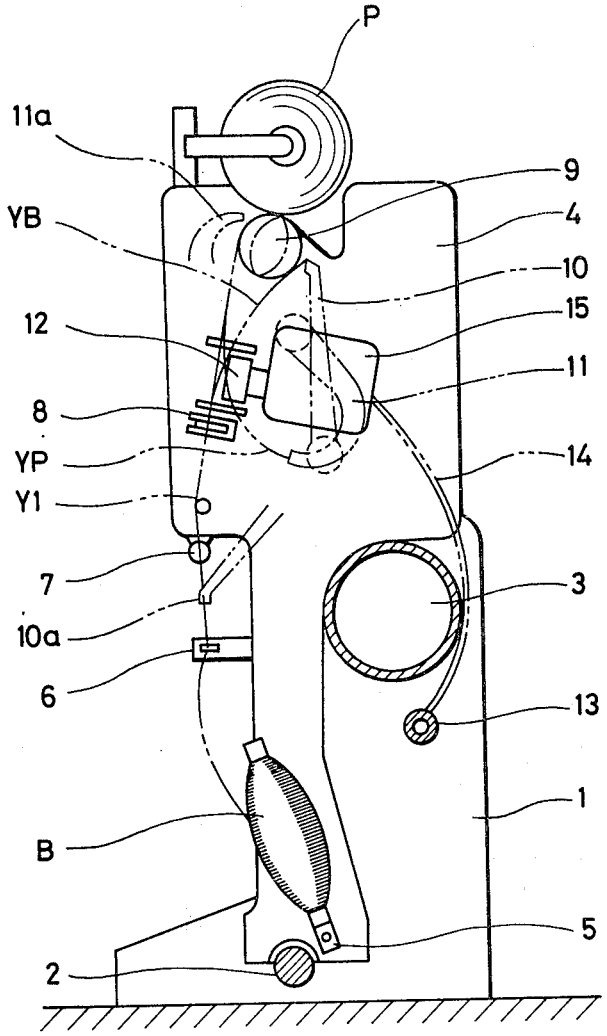
FIG. 1 is a schematic side view showing an embodiment of an automatic winder provided with a splicer.

Referring to FIG. 1 diagrammatically illustrating an automatic winder to which the apparatus of the present invention is applied, a shaft or pipe 2 and a suction pipe 3 are laid out between every two adjacent side frames 1, and a winding unit 4 is turnably supported by the shaft 2 and while the automatic winder is being operated, the winding unit 4 is placed also on the suction pipe 3 and appropriately secured in this state. The pipe 3 is connected to a blower not shown in the drawings and a suction stream always acts on the pipe 3.

In this winding unit, rewinding of a yarn from a bobbin B to a package P is accomplished in the following manner. A yarn Y1 is taken out from the bobbin B on a peg 5 through a guide 6 and an appropriate tension is applied to the yarn by a tenser 7. The yarn is then passed through a detecting device 8 for performing detection of yarn unevenness such as slub, cutting of the yarn and detection of running of the yarn and is then wound on the package P rotated by a winding drum 9.

When yarn unevenness is detected by the detecting device 8, a cutter arranged in the vicinity of the detecting device is actuated to cut the yarn Y1 and stop the winding operation. Simultaneously, a first yarn guide suction arm 10 is actuated to guide a yarn YB on the side of the bobbin B to a splicing apparatus 12 located at a position apart from a normal yarn travel passage Y1 and a second yarn guide suction arm 11 is actuated to guide a yarn YP on the side of the package P to the splicing apparatus 12. When splicing is completed in the splicing apparatus 12, the rewinding operation is started again. The first and second yarn guide suction arms 10 and 11 are connected to the pipe 3 performing the sucking action by the air stream. Since a fluid such as compressed air is used for the splicing apparatus 12, a conduit 14 is connected between another pipe 13 and a splicing box 15 to supply a compressed fluid to the splicing apparatus 12 from the pipe 13.

Figure 2:
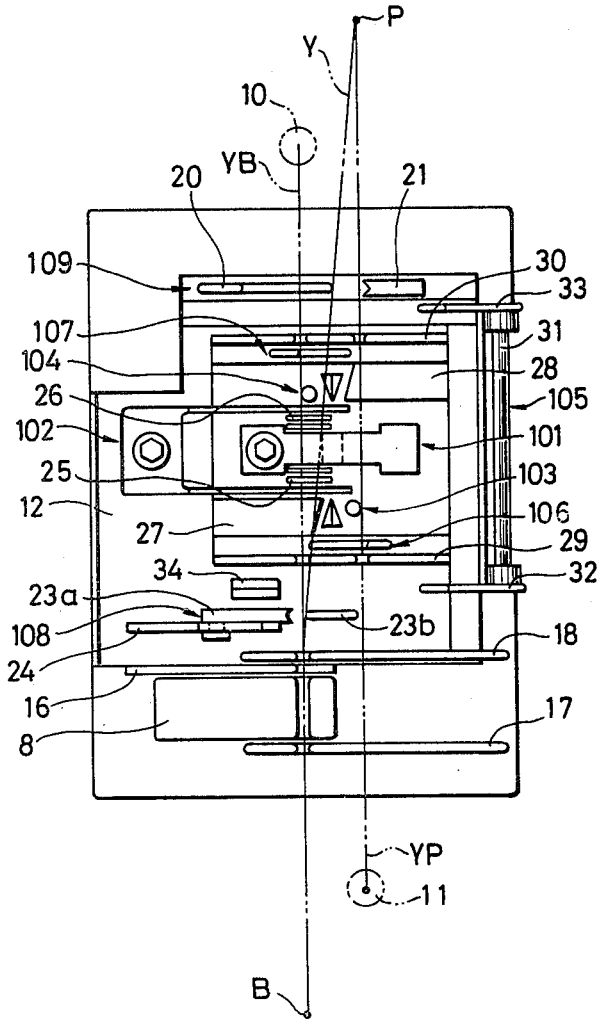
FIGS. 2 through 6 are side and plan views showing the entire structure of the splicer.
Figure 3:
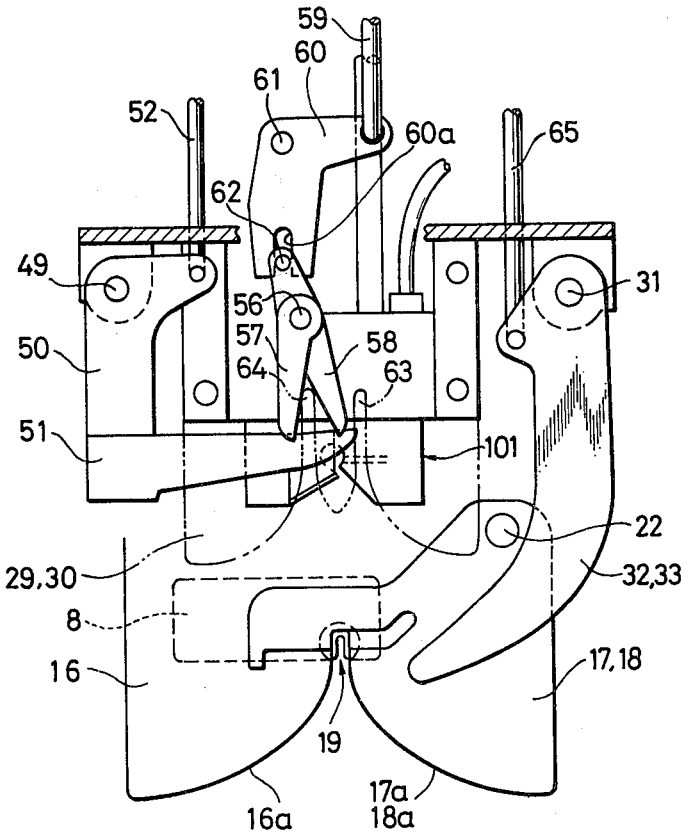

The entire structure of the splicing apparatus 12 is illustrated in detail in FIGS. 2 and 3. During the normal rewinding operation, the yarn Y is taken out from the bobbin B, is passed through the detecting device 8, a stationary guide 16 arranged on one end of the detecting device 8 and turnable guides 17 and 18 arranged on both the sides of the detecting device 8, travelled above the splicing apparatus 12 and wound on the package P.

The splicing apparatus 12 comprises as basic members a splicing member 101, yarn pressing device 102, control nozzles 103 and 104, a yarn gathering lever 105, yarn cutting devices 106 and 107 and yarn clamping devices 108 and 109. The abovementioned first and second suction arms 10 and 11 are turned and moved above the splicing apparatus 12 so that the suction openings on the top ends of the suction arms 10 and 11 intersect each other, and the first and second suction arms 10 and 11 suck the yarn ends YB and YP on the sides of the bobbin B and package P, move to the outside of the splicing apparatus 12 and stop there.

Figure 4:
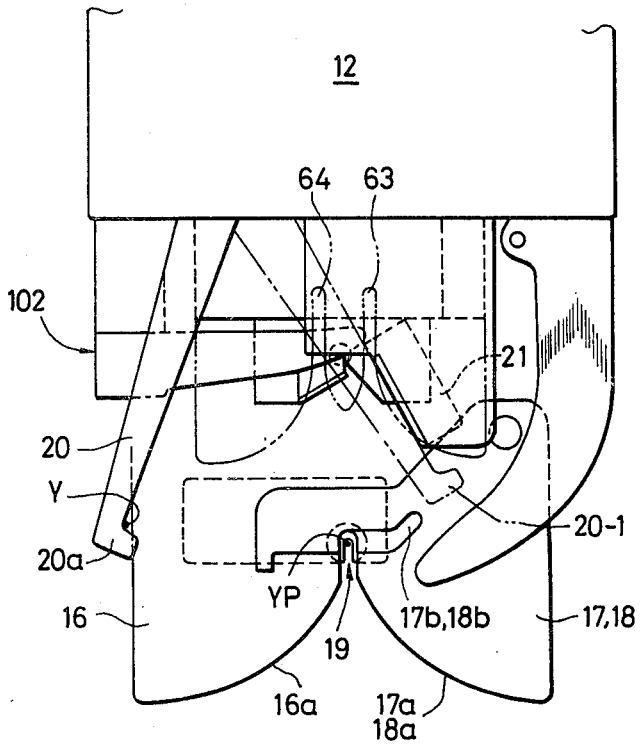

The first and second suction arms 10 and 11 are not simultaneously operated but they are operated with a certain time lag. More specifically, the yarn end YP on the side of the package P is turned to the outside of the splicing apparatus 12 by the suction arm 11 and substantially simultaneously with stoppage of the suction arm 11, a turning lever 20 of the clamping device 109 on the side of the package P is turned in the counterclockwise direction to a chain line position 20-1 as shown in FIG. 4 by a control cam not shown in the drawings and is brought into abutting contact with a supporting block 21 secured at a predetermined position, whereby the turning lever 20 is stopped. At this time, the yarn Y is moved in the state where the yarn Y is caught on a hook 20*a* of the turning lever 20 and the yarn Y is gripped between the supporting block 21 and the turning lever 20.

Figure 5:
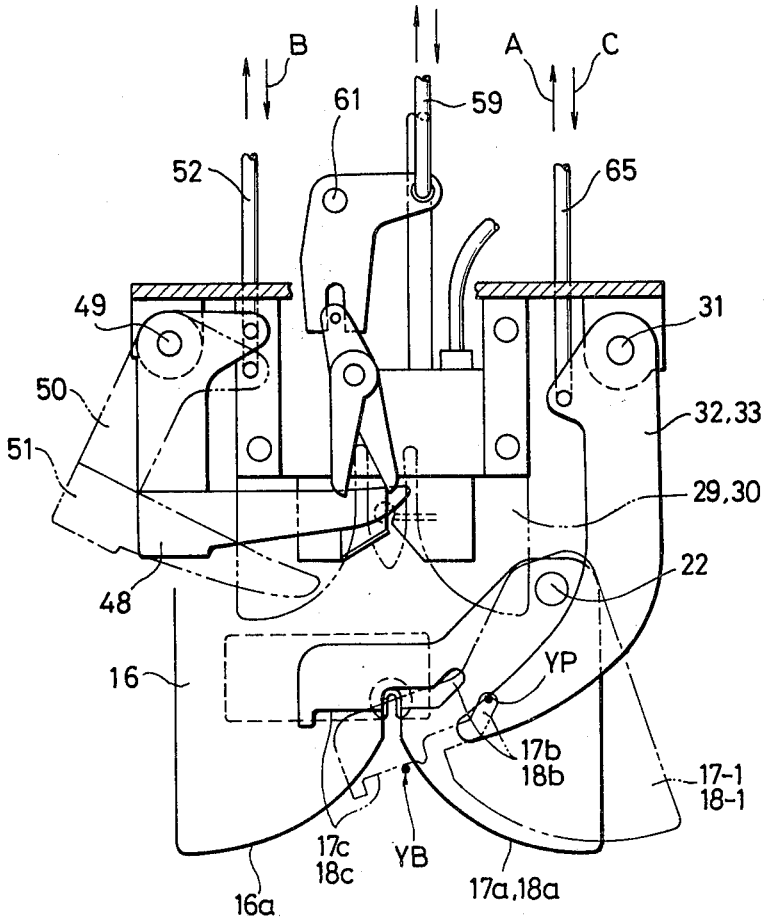
Figure 6:
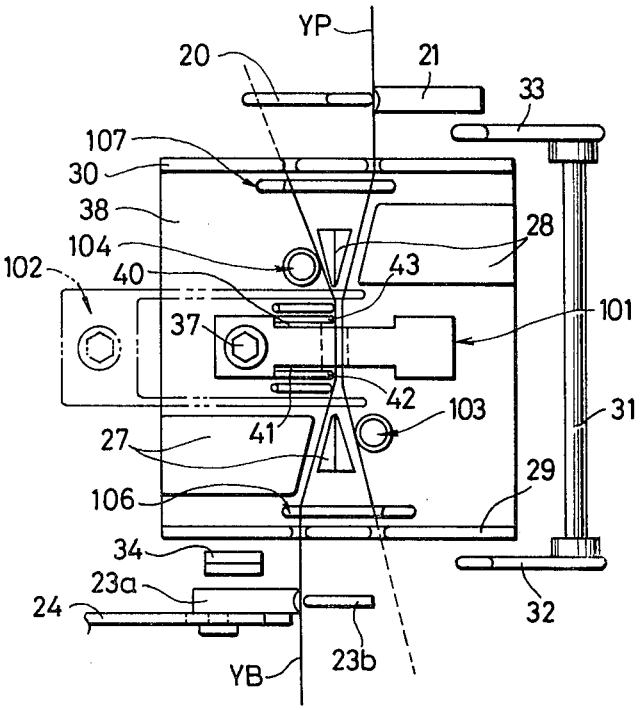

While the turning lever 20 is being operated, the yarn Y located on the stationary guide 16 and turning guides 17 and 18 is inserted in a guide groove 19 along inclined faces 16*a*, 17*a* and 18*a* of the guides 16, 17 and 18, and check of the absence or presence of the yarn Y or detection of erroneous suction of two or more of yarn by the suction arm 11 is performed by the detecting device 8 arranged at the same position as that of the guide groove 19. After confirmation of the presence of the yarn Y, the turning guides 17 and 18 are turned in the counterclockwise direction with a supporting shaft 22 being as the fulcrum as shown in FIG. 5 by a control cam not shown in the drawings. The yarn end YP is separated from the detecting device 8 and inserted into escape grooves 17*b* and 18*b* of the turning guides 17 and 18.

Substantially simultaneously with the turning guides 17 and 18, the yarn end YB on the side of the bobbin B is sucked by the suction arm 10, and the suction arm 10 is turned in the direction opposite to the turning direction of the suction arm 11 and is moved to the outside of the splicing apparatus 12 and stopped there. Substantially simultaneously with stopping of turning of the suction arm 10, a supporting plate 23*a* of the yarn clamping device 108 is turned along a guide plate 24 in the same direction as the turning direction of the turning lever 20 by a control cam not shown in the drawings in the state where the yarn is hung thereon, and the supporting plate 23*a* is stopped on abutting contact with a supporting block 23*b* secured at a predetermined position, whereby the yarn Y is gripped between the supporting plate 23*a* and the supporting block 23*b*. At this time, as shown in FIG. 5, the yarn YB is hung on hooks 17*c* and 18*b* formed in the vicinity of the top ends of the turning guides 17 and 18 by the turning movement of the guides 17 and 18, and checking in the detecting device 8 is performed after completion of the splicing operation.

The splicing member 101 is arranged substantially at the center of the splicing apparatus 12, and on both the sides of the splicing member 101, there are arranged yarn guide pins 25 and 26, pressing device 102, control nozzles 103 and 104 and yarn guides 27 and 28. Furthermore, there are arranged yarn cutting devices 106 and 107 and fork guides 29 and 30 in sequence. A yarn gathering lever 105 comprising a supporting shaft 31 and levers 32 and 33 turning with the shaft 31 being as the fulcrum is arranged in the side portion of the splicing member 101. After the detecting device 8 detects slub or other unevenness of the yarn Y to actuate a cutter not shown in the drawings to perform the cutting operation and the suction arms 10 and 11 are operated to guide the yarn ends YP and YB to the outside of the splicing apparatus 12, the yarn gathering lever 105 guides the yarn ends YP and YB toward the splicing apparatus 12. Incidentally, the turning range of the yarn gathering lever 105 is adjusted so that the yarn gathering lever 105 is stopped on abutting contact with a stopper 34 having a substantially V-shaped section, which is arranged between the fork guide 29 and the yarn clamping device 108. Accordingly, the range of turning of the yarn gathering lever 108 can also be adjusted by adjusting the position of the stopper 34.

The splicing apparatus will now be described in detail.

Figure 7:
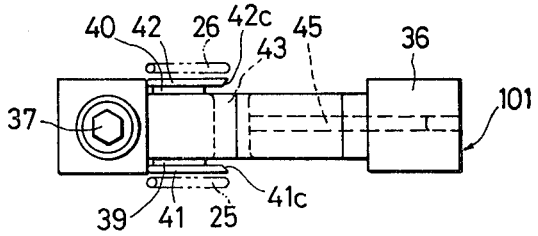
FIGS. 7, 8 and 9 are plan, side and sectional views showing one embodiment of the splicing apparatus according to the present invention.
Figure 8:
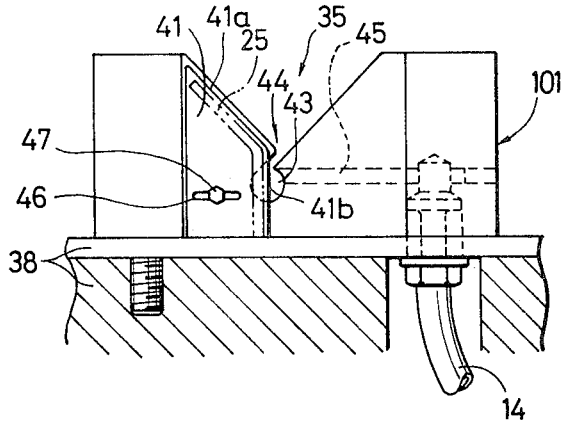
Figure 9:
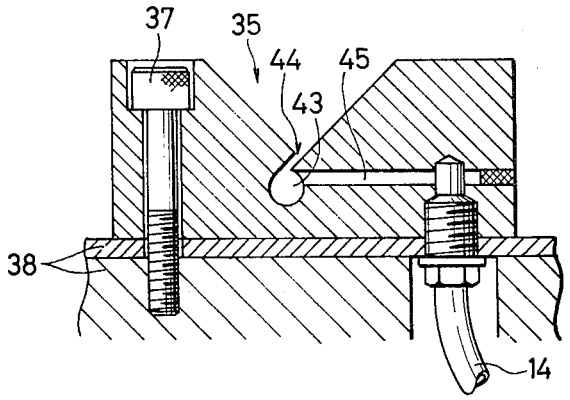

As shown in FIGS. 7 through 9, a splicing apparatus 101 is arranged substantially at the center of a splicer 12. A splicing member 36 having a V-groove having a V-shaped section is secured to a bracket 38 by a screw 37 at the center of the splicing apparatus 101, and two control members 41 and 42 are arranged on both the sides of the splicing member 36 through spacers 39 and 40. In the splicing member 36, a cylindrical splicing hole 43 is formed on the lower end portion of the V-groove to pierce through the splicing member 36, and a slit 44 extended from the lower end of the V-groove to the upper portion of the splicing hole 43 in the tangential direction is formed entirely along the longitudinal direction. A jet nozzle hole 45 opened in the tangential direction is formed in the upper portion of the splicing hole 43.

Each of the plate-like control members 41 and 42 is secured to the splicing member 36 by a screw 47 so that it can be advanced and retreated and the circular section of the splicing hole 43 is substantially covered by the control member. The top edges 41*a* and 42*a* of the control members 41 and 42 are in parallel to the V-groove 35 of the splicing member 36 and the front edges 41*b* and 42*b* of the control members 41 and 42 are vertical to the bracket 38. When these front edges 41*b* and 42*b* are orthographically seen, they have inclined faces 41*c* and 42*c* on the inner sides thereof. The control members 41 and 42 as a whole are arranged to stand back from the V-groove 35 so that the yarn ends YB1 and YP1 are not entangled with the control members 41 and 42 at the splicing step.

Yarn guide pins 27 and 28 are vertically arranged outside the control members 41 and 42 to prevent the yarns YP and YB from entering in the space S1 formed between the control members 41 and 42 and the bracket 38, and these guide pins 27 and 28 also exert the function of assisting the action of the control members 41 and 42.

Incidentally, a compressed fluid is supplied to the jet nozzle hole 39 through the above-mentioned conduit 14.

Figure 10A:
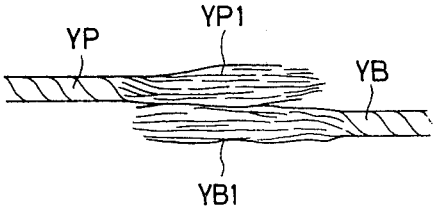
FIG. 10 is a diagram showing the mode of splicing.
Figure 10B:
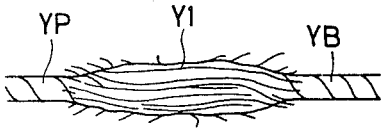
Figure 10C:
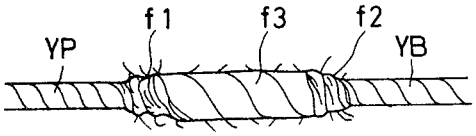
Figure 12A:
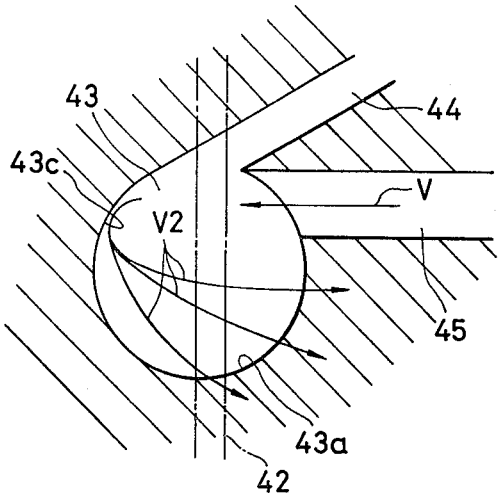
FIG. 12 is a plan and sectional side view showing the conventional splicing apparatus in which the control members of the present invention are used.
Figure 12B:
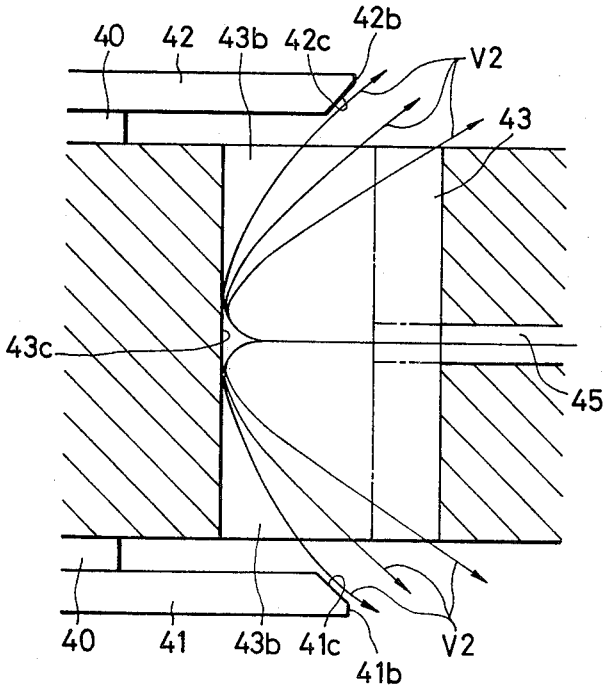

The course of formation of a joint by the splicing operation is illustrated in FIGS. 10 and 12. The yarn end YB on the side of the bobbin B and the a yarn end end YP on the side of the package P, which are to be spliced, are inserted from the slit 44 opened to one end of the splicing hole 43, and the yarn ends are placed in such a state that the yarn ends substantially confront the opening of the slit 44 and are brought into contact with the inner circumferential face 43*a* of the splicing hole 43. When a compressed fluid V is jetted into the splicing hole 43 in this state, the compressed fluid V flows along the inner circumferential face 43*a* of the splicing hole 43 and is discharged from both the open ends 43*b* of the splicing hole 43.

As shown in FIG. 10-*a*, the yarn ends YB1 and YP1 to be spliced are untwisted by splicing control nozzles 103 and 104 described hereinafter before they are guided into the splicing hole 43, and in these yarn ends YB1 and YP1, respective fibers are arranged substantially in parallel to one another. These fibers are moved along the locus Q of the fluid, and as shown in FIG. 10-*b*, they are mingled and integrated together. Then, as shown in FIG. 10-*c*, the respective fibers of both the yarn ends are strongly entangled with one another by the action of the swirling stream of the fluid, and twists f3 are given between both the wrapped portions f1 and f2.

Figure 11A:
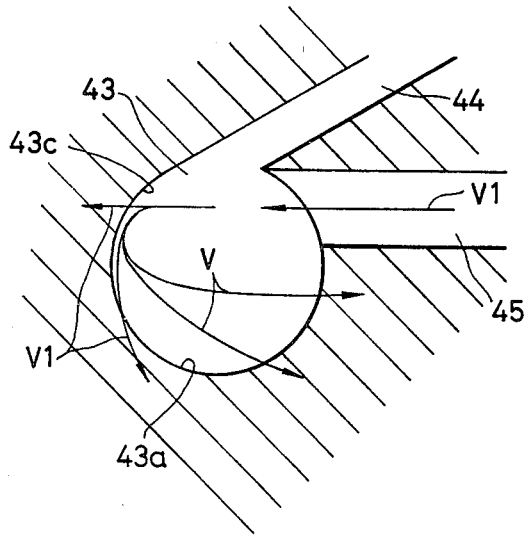
FIG. 11 is a plan and sectional side view showing the conventional splicing apparatus.
Figure 11B:
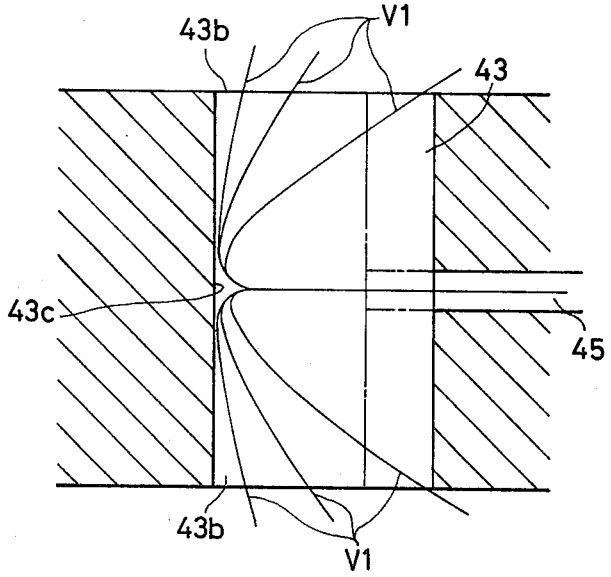

The action of the control members will now be described. As shown in FIG. 11, in the case where control members 41 and 42 are not disposed as in the conventional splicing apparatus, the compressed fluid V jetted into the splicing hole 43 from the jet nozzle hole 45 impinges against the inner circumferential face 43*c* confronting the jet nozzle hole 45, and the fluid is dispersed and discharged in the direction V2, that is, toward both the open ends 43*b*. However, if the control members 41 and 42 are used, as shown in FIG. 12, the stream of the compressed fluid V flows while drawing a large spiral curve V2 and is discharged to the outside. When the flow of the compressed fluid is seen from the open end 43*b*, the compressed fluid V jetted from the jet nozzle hole 45 impinges against the upper portion of the inner circumferential face 43*c* confronting the hole 45, swirls downward along the inner circumferential face 43*a* of the splicing hole 43, arrives at the front edges 41*b* and 42*b* of the control members 41 and 42 and is then discharged to the outside. During this course of the travel, the initially jetted amount of the fluid V is substantially retained. Accordingly, the majority of the compressed fluid is swirled and turned effectively to strongly balloon the yarn ends YP1 and YB1. The inclined faces 41C and 42C formed on the front edges 41*b* and 42*b* of the control members 41 and 42 are disposed to guide the stream of the compressed fluid to be discharged to the outside.

Figure 13:
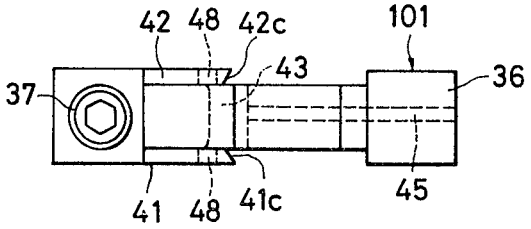
FIG. 13 is a plan view illustrating another embodiment of the splicing apparatus of the present invention.

The function of the spacer 40 will now be described. When the compressed fluid is discharged to the outside, in order to eliminate swirling streams formed by impingement against the control members 41 and 42, a part of the fluid is discharged from the space S2 formed between this spacer 40 and the splicing member 36. Instead of this embodiment using this spacer, there may be adopted a modification shown in FIG. 13, in which control members 41 and 42 having an escape hole 48 at the center therebetween are arranged in close proximity to the splicing member 36 so that a part of the fluid is discharged to the outside through this escape hole 48. The above-mentioned spacer 40 is very effective for increasing the quantity of the compressed fluid impinging against the walls of the control members 41 and 42 and flowing toward the slit 44 and preventing the yarn Y from flying out.

Figure 14A:
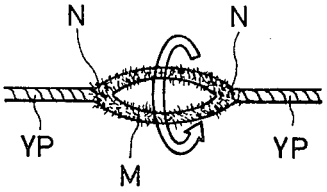
FIG. 14 is a diagram showing the mode of splicing.
Figure 14B:
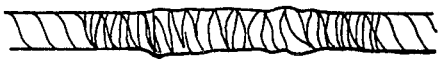
Figure 14C:
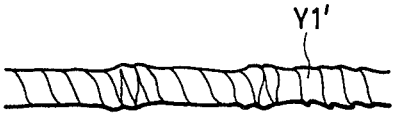
Figure 15:
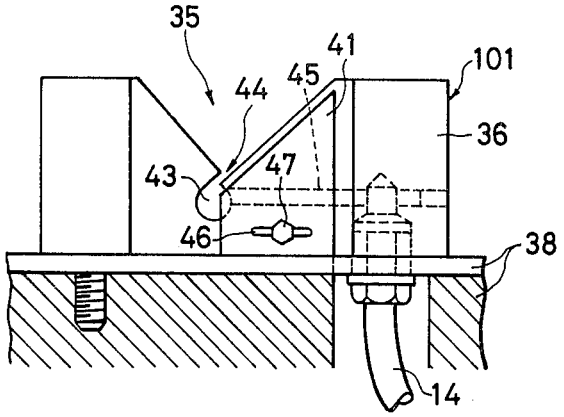
FIGS. 15 and 16 are side views illustrating another embodiments of the splicing apparatus of the present invention.
Figure 16:
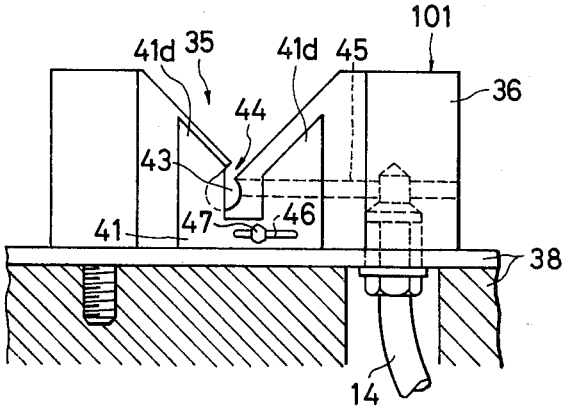

Various defects are sometimes brought about on the formed joint according to the kind of the yarn Y or the number of twists per unit length. The above-mentioned control members 41 and 42 have an effect of eliminating these defects. When the compressed fluid acts on the yarn ends YP1 and YB1, as shown in FIG. 14-*a*, a balloon M is formed, and if the rotation number of the balloon is increased, the fibers located in the vicinity of the balloon neck N become disintegrated and disentangled and yarn breakage is readily caused in this portion. Moreover, it sometimes happens that as shown in FIG. 14-*b*, respective fibers of the joint portion are entangled at an angle close to a right angle to the axial direction of the yarn and the appearance of the joint is degraded. Furthermore, as shown in FIG. 14-*c*, one yarn end Y1' undergoes the untwisting action of the balloon. According to the present invention, by disposition of the control members 41 and 42, a spiral stream of the compressed fluid is stably formed within the splicing hole as described hereinbefore, and undesirable shaping of the yarn ends YP and YB is eliminated and occurrence of the above disadvantages is prevented. Furthermore, the attachment position of the control members can freely be adjusted, and therefore, the section of the splicing hole 43 can be covered by the control members 41 and 42 at an optional position with an optional covered area. Accordingly, the rotation number of the balloon can be controlled appropriately according to the kind of yarn and a joint having a desirable binding strength and a desirable appearance can optionally be obtained. From the results of experiments made by us, it has been confirmed that in the case where, as shown in FIG. 12, the control members 41 and 42 are arranged on the side opposite to the jet nozzle hole 45, as the area of the splicing hole 43 covered by the control members 41 and 42, the binding strength of the joint is increased but if too large an area is covered, the appearance value of the joint is degraded, and that in the case where, as shown in FIG. 15, the control members 41 and 42 are arranged on the side of the jet nozzle hole 45, the appearance value is high but the binding strength is relatively low. Accordingly, there may be adopted a modification shown in FIG. 16, in which the control members 41 and 42 are formed to have a substantially U-figured shape, the positions of the control members 41 and 42 are adjustable by long holes 46 and screws 47 and each of the open ends 43*b* of the splicing hole 43 is covered to an optional extent from both the right and the left by lugs 41*d* and 42*d* of the control members 41 and 42. Furthermore, there may be adopted a modification in which the control members 41 and 42 are arranged dismountably from the splicing member 36 and control members having a size suitable for the intended joint are set at the splicing member 36. In the present invention, the shape, size, attachment method and adjustment method of the control members 41 and 42 are not particularly critical and are not limited to those specifically described above.

Referring to FIGS. 2 and 3, the pressing device 102 arranged on both the sides of the splicing member 101 cooperates with turning of the yarn gathering lever 105 at the splicing step to take out the yarn ends YP1 and YB1 untwisted by the splicing control nozzles 103 and 104 and set them within the splicing hole 43 and simultaneously, the pressing device 102 controls the positions of both the yarns YP and YB. In the pressing device 102, a pressing plate 51 is screwed to a turning lever 50 turnable with a supporting shaft 49 fixed at a constant position being as the fulcrum and if a rod 52 is operated by a control cam not shown in the drawings, the pressing plate 51 is turned as shown in FIG. 5.

Figure 17:
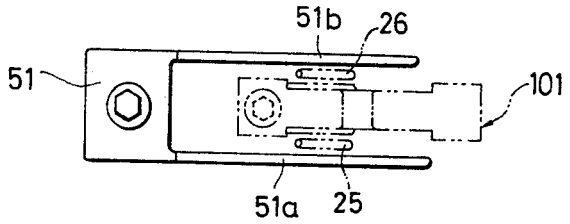
FIGS. 17 and 18 are plan and side views illustrating in detail the yarn pressing device.
Figure 18:
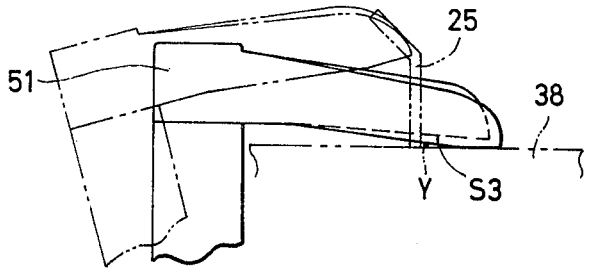

The yarn pressing plate 51 is illustrated in detail in FIGS. 17 and 18. The pressing plate 51 has forked pieces 51*a* and 51*b* extended to the top end, and these forked pieces are different to some extent in the shape. When the pressing plate 51 is turned and one forked piece 51*a* falls in abutting contact with the face of the bracket 38 to press the yarn Y among the top face of the bracket 38, the yarn guide pin 25 and the forked piece 51*a*, a certain space S3 allowing passage of the yarn Y is formed among the other forked piece 51*b*, the top face of the bracket 38 and the yarn guide pin 26, whereby the position control is effected only in the direction traversing the yarn Y at a right angle.

The yarn pressing action of the forked piece 51*a* of the pressing plate 51 is performed to prevent return of twist caused by the action of a balloon formed on the yarn ends YB1 and YP1 by the action of the compressed fluid as described hereinbefore.

Accordingly, the degree of this pressing action is controlled to such an extent that twists on the yarn Y are not released by the action of the balloon. If this pressing action is too strong, fluffs are formed and no good results can be obtained. Since the other yarn Y is rotated in the twisting direction by the action of the balloon, this yarn need not particularly be held and it is sufficient if this yarn Y is pressed only to such a degree that the position thereof is controlled.

Figure 19:
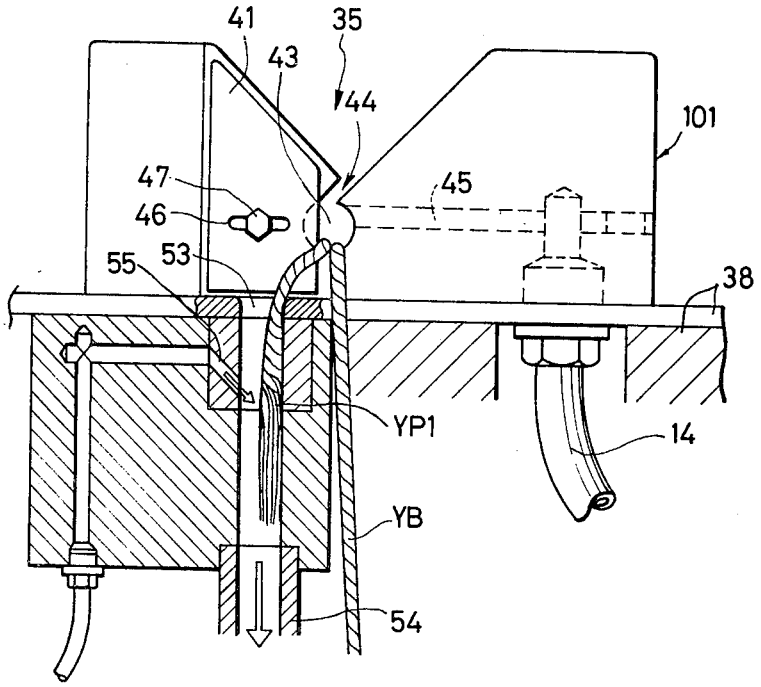
FIG. 19 is a longitudinally sectional view illustrating the entire structure of the control nozzle.

As shown in FIG. 19, a nozzle hole 53 for untwisting the yarn ends YB1 and YP1 is formed on the yarn control nozzles 103 and 104 arranged on both the sides of the pressing device 102, and the yarn end YB1 on the side of the bobbin B and the yarn end YP1 on the side of the package P, which are to be spliced together, are guided into this nozzle hole 53 through the yarn splicing hole 43. Introduction of the yarn ends YB1 and YP1 is accomplished by the sucking action of the above-mentioned suction pipe 3 through a flexible pipe 54. When the yarn end YP1 is guided into the nozzle hole 53, a fluid is jetted from a jet nozzle 55 opened obliquely to the nozzle hole 53 to untwist the yarn end YP1 and arrange the respective fibers in parallel to one another.

Referring to FIGS. 2 and 3, the cutting devices 106 and 107 have a scissor-like shape, and in each cutting device, a movable blade 58 is turned with a stationary pin 56 being as the fulcrum so that the movable blade 58 intersects a stationary blade 57, whereby the yarn Y is cut. When a rod 59 is actuated by a control cam not shown in the drawings, a bifurcate lever 60 is turned in the clockwise or counterclockwise direction with a shaft 61 being as the fulcrum, and the fork-like portion 60*a* of the lever 60 moves a supporting pin 62 on the other end of the movable blade 58, whereby the movable blade 58 is operated.

Fork guides 29 and 30 are arranged outwardly of the yarn cutting devices 106 and 107, and guide grooves 63 and 64 are formed on the fork guides 29 and 30, respectively.

The yarn gathering lever 105 arranged in the side portion of the splicing apparatus 12 is turned in the clockwise direction with a shaft 31 being as the fulcrum to introduce the yarns YP and YB into guide grooves 63 and 64 when a rod 65 is operated by a control cam not shown in the drawings.

What is claimed is:

1. A splicing apparatus for spun yarns where a yarn end on the package side and a yarn end on the bobbin side are introduced and lapped in a splicing hole formed on a splicing member and a compressed fluid is jetted on the lapped portion of the yarn ends to effect splicing, said splicing apparatus being characterized in that two control members of which positions are adjustable are arranged making a right angle with the axial line of the splicing hole on both the sides of the splicing member so that the lapped portion is put between the two control members and a part of openings of the splicing hole is covered by the control members.

2. A splicing apparatus for spun yarns as claimed in claim 1, wherein said control members are plate-like shapes having a long hole perforated therethrough and are secured to a splicing member by a screw inserted into the long hole so that the control member can be advanced or retreated to cover a part of the opening of the splicing hole.

3. A splicing apparatus for spun yarns as claimed in claim 2, wherein a spacer is disposed between the side face of the splicing member and the control plate without covering the opening of the splicing hole.

4. A splicing apparatus for spun yarns as claimed in claim 2, wherein said control members have an escape hole at the center thereof so that a part of the fluid is discharged to the outside through the escape hole.

5. A splicing apparatus for spun yarns as claimed in claim 2, wherein said splicing members comprises a V-groove having a V-shaped section, a cylindrical splicing hole formed on the lower end portion of the V-groove to pierce through the splicing member, a slit extended from the lower end of the V-groove to the upper portion of the splicing hole in the tangential direction and formed entirely along the longitudinal direction, and a jet nozzle opened in the tangential direction to the splicing hole formed in the upper portion of the splicing hole, and said control members are so formed that the top edges of the control member are in parallel to the V-groove of the splicing member and the front edges of the control member are vertical to a bracket, said front edges having inclined faces on the sides confronting to the splicing hole to guide the stream of the compressed fluid to be discharged to the outside.

6. A splicing apparatus for spun yarns as claimed in claim 5, wherein the control members are arranged on the side opposite to the jet nozzle hole as the area of the splicing hole covered by the control members.

7. A splicing apparatus for spun yarns as claimed in claim 5, wherein said control members are arranged on the side of the jet nozzle hole.

8. A splicing apparatus for spun yarns as claimed in claim 5, wherein said control members are formed to have a substantially U-figured shape with two lug portions so that the position of the control member are adjustable by means of long holes and screws to cover the opening of the splicing hole from both the right and the left by the lug portions of the control member.

* * * * *